US005984540A

United States Patent [19]

Mimasaka et al.

[11] Patent Number: 5,984,540

[45] Date of Patent: Nov. 16, 1999

[54] DEVELOPING APPARATUS AND DEVELOPING METHOD

[75] Inventors: Masahiro Mimasaka; Minobu Matsunaga; Akiko Tanaka; Koji Uchitani, all of Kyoto, Japan

[73] Assignee: Dainippon Screen Mfg. Co., Ltd., Japan

[21] Appl. No.: 08/997,083

[22] Filed: Dec. 23, 1997

[30] Foreign Application Priority Data

Dec. 26, 1996 [JP] Japan ..... 8-348771
Apr. 28, 1997 [JP] Japan ..... 9-110816

[51] Int. Cl.[6] ..... G03D 5/00

[52] U.S. Cl. ..... 396/604; 396/611; 396/627; 118/677

[58] Field of Search ..... 396/604, 611, 396/627; 118/52, 63, 677, 676, 712, 323; 156/345

[56] References Cited

U.S. PATENT DOCUMENTS 5,489,337 2/1996 Nomura et al. ..... 118/677
5,625,433 4/1997 Inada et al. ..... 396/604

FOREIGN PATENT DOCUMENTS 9-251953 9/1997 Japan ..... 396/FOR 942
9-271705 10/1997 Japan ..... 396/FOR 942

*Primary Examiner*—D. Rutledge
*Attorney, Agent, or Firm*—Ostrolenk, Faber, Gerb & Soffen, LLP

[57] ABSTRACT

A developing apparatus in which a substrate holding part holds a substrate in a stationary state, and a developer discharge nozzle starts scanning from a scanning start position. After scanning starts, the developer discharge nozzle discharges a developer at a discharge start position before a slit discharge port thereof reaches the substrate. The developer discharge nozzle moves linearly on the substrate in a scanning direction while discharging the developer, passes over the substrate, and thereafter stops discharging the developer at a discharge stop position separated from the substrate. The developer discharge nozzle stops scanning when reaching a scanning stop position.

28 Claims, 8 Drawing Sheets

DEVELOPING APPARATUS AND DEVELOPING METHOD

BACKGROUND OF THE INVENTION

1. Field of the Invention

The present invention relates to a developing apparatus for developing a photosensitive film provided on a substrate by supplying a developer.

2. Description of the Background Art

A developing apparatus is employed for developing a photosensitive film which is formed on a substrate such as a semiconductor wafer or a glass substrate for a liquid crystal display unit, a photomask or an optical disk.

For example, a rotary developing apparatus comprises a rotation holding part for horizontally holding a substrate and for rotating the same about a vertical axis, and a developer discharge nozzle for supplying a developer on the surface of the substrate. The developer discharge nozzle is mounted on the forward end of a nozzle arm which is rotatable in a horizontal plane, and can move between a position above the substrate and a buffer position.

In the development process, the developer discharge nozzle moves from the buffer position to the position above the substrate, and thereafter supplies the developer to a photosensitive film provided on the substrate. The supplied developer is spread on the overall surface of the substrate following rotation thereof, to be in contact with the photosensitive film. The substrate is maintained in a stationary state for a constant time while the developer is kept thereon by its surface tension (mounding), whereby the photosensitive film is developed. When completely supplying the developer, the developer discharge nozzle moves to the buffer position, separated from the position above the substrate, by rotation of the nozzle arm.

When the developer is exposed to the atmosphere in the vicinity of a discharge port of the developer discharge nozzle, moisture contained in the developer evaporates and changes the concentration of the developer, or the developer comes into contact with air and becomes denatured. In advance of the development, therefore, the developer discharge nozzle partially discharges the developer in the vicinity of the discharge port on the buffer position (predispense treatment), thereby homogenizing the developer stored therein.

In the aforementioned conventional rotary developing apparatus, however, the developer strikes the rotated substrate in an initial stage of discharge, and applies a remarkable impact to the photosensitive film provided on the substrate. This impact causes bubbles in the developer, and small bubbles remaining on the surface of the photosensitive film may result in defective development. Further, the photosensitive film may be damaged by the impact applied by the developer in the initial stage of discharge.

After the predispense treatment, the developer comes into contact with the air in the vicinity of the discharge port of the developer discharge nozzle which moves from the buffer position to the position above the substrate. Thus, there is a possibility that part of the developer supplied onto the substrate immediately after the start of discharge is slightly denatured as compared with developer which is continuously supplied thereafter. Thus, defective development may be caused on the substrate which is in contact with the developer immediately after the start of discharge. In addition, the developer may be dried due to contact with the air to cause particles to adhere onto the substrate.

Further, the developer dropped on the substrate is irregularly spread on the overall surface of the substrate due to centrifugal force. Thus, the developer must be supplied in a large quantity, to be homogenized on the substrate.

SUMMARY OF THE INVENTION

The present invention is directed to an apparatus for developing a substrate by discharging a developer to the substrate.

According to the present invention, this apparatus comprises a) holding means for holding a substrate in a horizontal state, b) a developer discharge nozzle for discharging a developer to the substrate, c) moving means for moving the developer discharge nozzle from a scanning start position on a first side in the exterior of the substrate held by the substrate holding means in a stationary state to a scanning stop position on a second side in the exterior of the substrate through the substrate in a prescribed scanning direction, and d) discharge control means for controlling the developer discharge nozzle to start discharging the developer before reaching a first end of the substrate closer to the first side.

The developer discharge nozzle starts discharging the developer before reaching the stationary substrate, thereby preventing the developer from applying an impact to the substrate in an initial stage of discharge. Thus, formation of bubbles in the developer is suppressed to prevent defective development, and a photosensitive film provided on the substrate is prevented from damage by an impact.

Part of the developer which comes into contact with the air in a portion close to a discharge port during movement of the developer discharge nozzle is discarded to the exterior and the developer discharge nozzle newly supplies the developer onto the stationary substrate when reaching the substrate. Thus, the developer is prevented from causing defective development by denatured part, and the surface of the substrate is prevented from adhesion of particles formed by dried part of the developer.

Further, the developer discharge nozzle passing over the substrate continuously newly supplies the developer to the substrate, whereby the substrate is homogeneously supplied with the developer.

In addition, the developer is continuously supplied from an edge to another edge of the stationary substrate, whereby wasteful consumption of the developer is reduced and the photosensitive film provided on the substrate is homogeneously developed with a small quantity of developer.

In a preferred embodiment of the present invention, the discharge control means controls the developer discharge nozzle to start discharging the developer at a position between the scanning start position and the first end.

In another preferred embodiment of the present invention, the discharge control means controls the developer discharge nozzle to start discharging the developer at the scanning start position.

The present invention is also directed to a method of developing a substrate by discharging a developer thereto.

Accordingly, an object of the present invention is to provide a developing apparatus which can homogeneously develop a photosensitive film provided on a substrate with a small quantity of developer.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
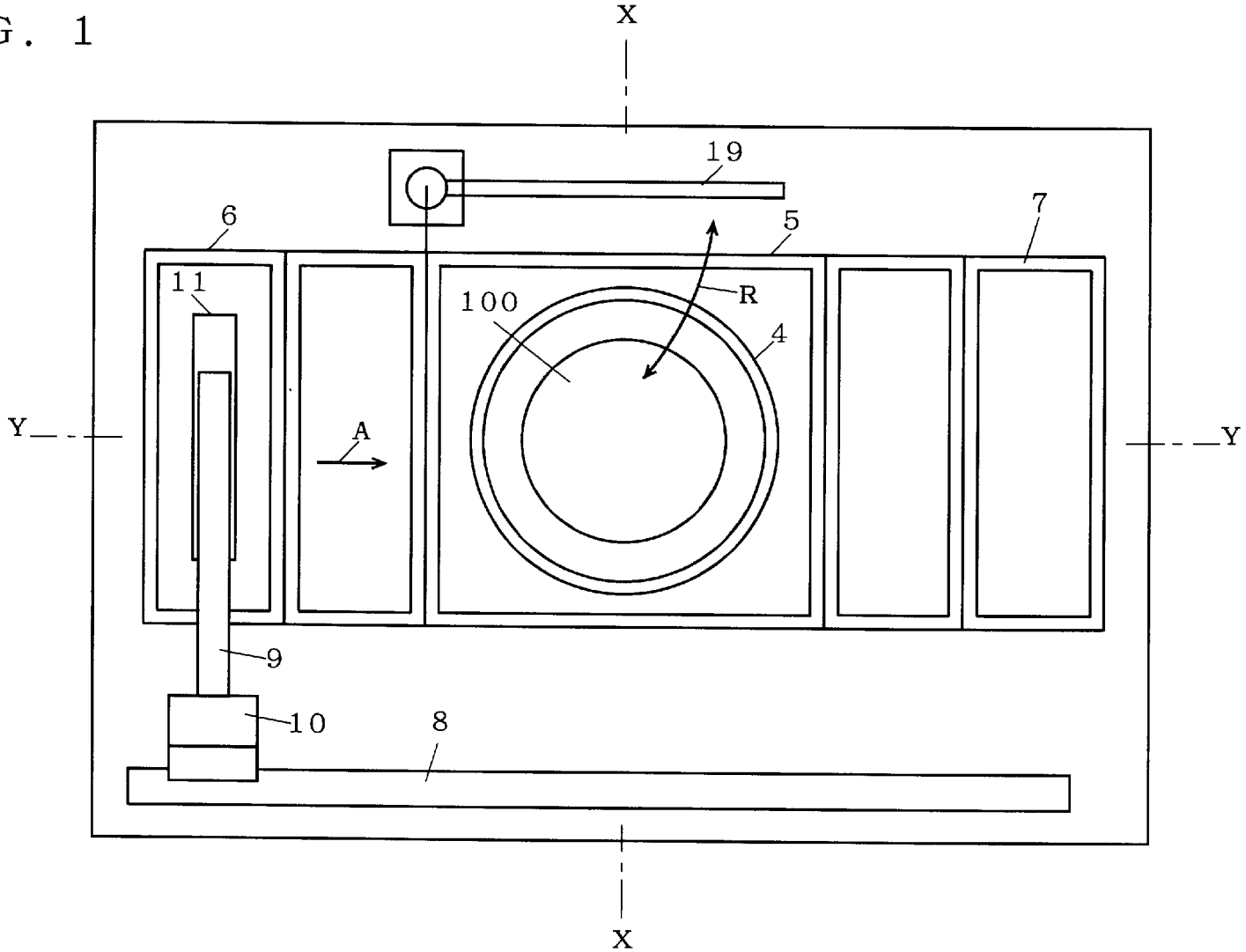
FIG. 1 is a plan view showing a developing apparatus according to a first embodiment of the present invention.
Figure 2:
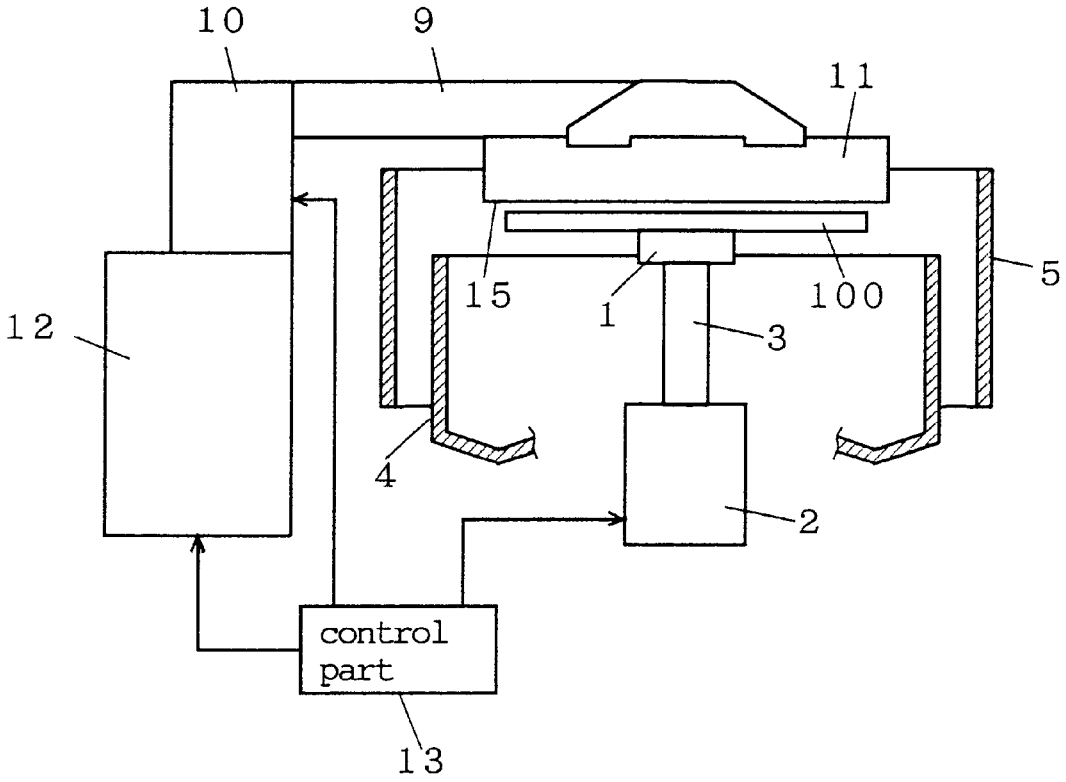
FIG. 2 is a sectional view, showing a principal part of the developing apparatus, taken along the line X—X in FIG. 1.
Figure 3:
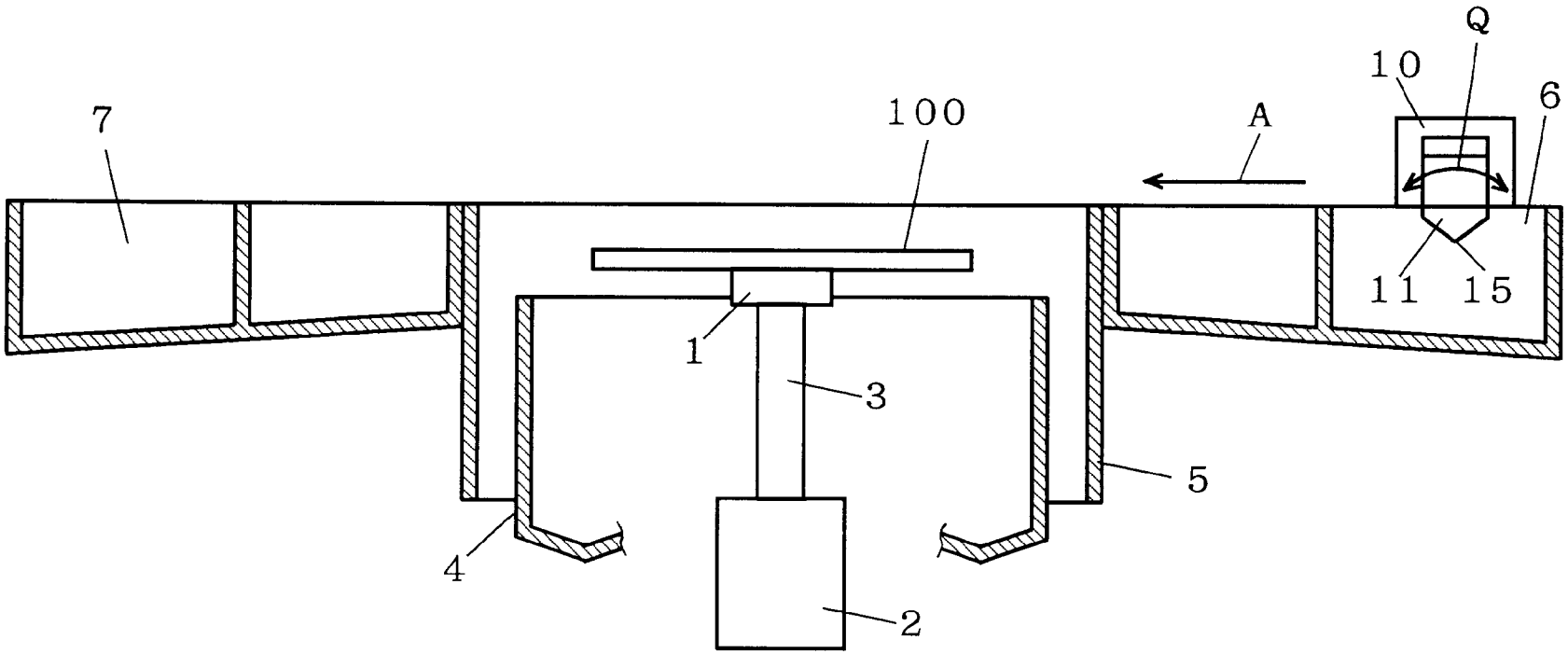
FIG. 3 is a sectional view, showing the principal part of the developing apparatus, taken along the line Y—Y in FIG. 1.

FIG. 1 is a plan view showing a developing apparatus according to a first embodiment of the present invention, FIG. 2 is a sectional view, showing a principal part of the developing apparatus, taken along the line X—X in FIG. 1, and FIG. 3 is a sectional view, showing the principal part of the developing apparatus, taken along the line Y—Y in FIG. 1.

As shown in FIGS. 2 and 3, the developing apparatus comprises a substrate holding part 1 for suction-holding a substrate 100 in a horizontal state. The substrate holding part 1 is fixed to the forward end portion of a rotary shaft 3 of a motor 2, to be rotatable about a vertical axis. A vertically movable circular inner cup 4 is provided around the substrate holding part 1, to enclose the substrate 100. A square outer cup 5 is provided around the inner cup 4.

As shown in FIG. 1, buffer pots 6 and 7 are arranged on opposite sides of the outer cup 5 respectively, and a guide rail 8 is provided along a side portion of the outer cup 5. A nozzle arm 9 is provided to be movable in a scanning direction A and an opposite direction along the guide rail 8 by an arm driving part 10. A de-ionized water discharge nozzle 19 for discharging de-ionized water is provided along another side portion of the outer cup 5, to be rotatable along arrow R.

A developer discharge nozzle 11 having a slit discharge port 15 on its lower end portion is mounted on the nozzle arm 9 perpendicularly to the guide rail 8. Thus, the developer discharge nozzle 11 is linearly translatable from the position of the buffer pot 6 to that of the buffer pot 7 over the substrate 100 along the scanning direction A. As shown in FIG. 3, the developer discharge nozzle 11 is rotatable along arrow Q.

As shown in FIG. 2, the developer discharge nozzle 11 is supplied with a developer from a developer supply system 12. A controller 13 controls rotation of the motor 2, scanning of the developer discharge nozzle 11 by the arm driving part 10, and discharge of the developer from the developer discharge nozzle 11.

In this embodiment, the substrate holding part 1, the arm driving part 10 and the controller 13 correspond to substrate holding means, moving means and discharge control means respectively.

Figure 4:
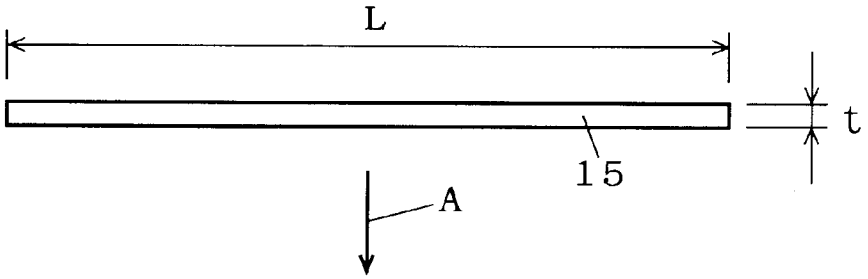
FIG. 4 illustrates a slit discharge port of a developer discharge nozzle.

FIG. 4 illustrates the slit discharge port 15 of the developer discharge nozzle 11. The slit width t of the slit discharge port 15, which is 0.02 to 0.5 mm in general, is 0.1 mm according to this embodiment. The discharge width L of the slit discharge port 15 is set to be identical to or larger than the diameter of the substrate 100 to be treated. This slit discharge port 15 is arranged perpendicularly to the scanning direction A of the developer discharge nozzle 11.

Figure 5:
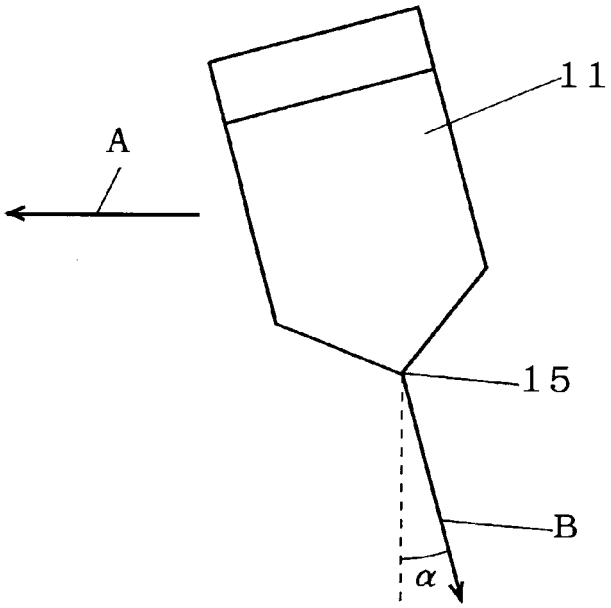
FIG. 5 is a side elevational view showing a direction for discharging a developer from the developer discharge nozzle.

FIG. 5 is a side elevational view showing a direction for discharging the developer from the developer discharge nozzle 11. In development, the developer discharge nozzle 11 is so inclined as to incline a developer discharge direction B at an angle $\alpha$ from the normal (vertical downward) direction of the substrate 100 oppositely to the scanning direction A. The inclination angle $\alpha$, which is in the range of 0 to 30° in general, is set at 20° according to this embodiment.

The developer discharge nozzle 11 scans the substrate 100 to keep a distance of 0.2 to 5 mm, more preferably 0.5 to 2.0 mm, between the slit discharge port 15 and the upper surface of the substrate 100. According to this embodiment, the distance between the slit discharge port 15 and the upper surface of the substrate 100 is set at 1~1.5 mm.

Figure 6:
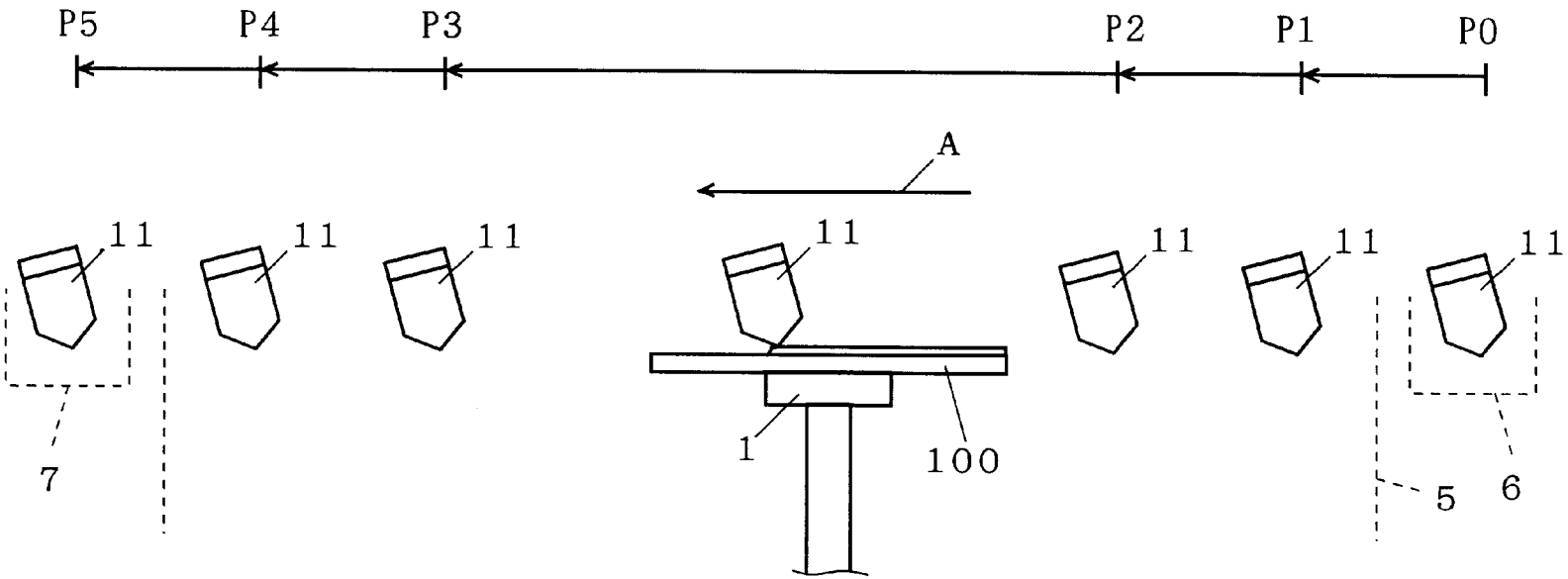
FIG. 6 is adapted to illustrate an exemplary operation of the developing apparatus shown in FIG. 1.

An operation of the developing apparatus shown in FIG. 1 is now described with reference to FIG. 6. In the development, the substrate holding part 1 holds the substrate 100 in a stationary state.

In a standby time, the developer discharge nozzle 11 stands by at a position P0 in the buffer pot 6. In the development, on the other hand, the developer discharge nozzle 11 moves upward, thereafter moves in the scanning direction A, and moves downward at a scanning start position P1 in the outer cup 5.

Thereafter the developer discharge nozzle 11 starts scanning from the scanning start position P1 at a prescribed scanning rate. At this point of time, the developer discharge nozzle 11 does not yet discharge the developer. According to this embodiment, the scanning rate is set at 10 to 500 mm/sec.

After the start of scanning, the developer discharge nozzle 11 starts discharging the developer at a discharge start position P2 at a prescribed flow rate before the slit discharge port 15 thereof reaches the substrate 100. According to this embodiment, the flow rate for the developer is set at 1.5 L/min.

The developer discharge nozzle 11 moves linearly over the substrate 100 from the discharge start position P2 along the scanning direction A, while discharging the developer. Thus, the developer is continuously supplied to the overall surface of the substrate 100. The supplied developer is kept on the substrate 100 by its surface tension.

After passing over the substrate 100, the developer discharge nozzle 11 stops discharging the developer at a discharge stop position P3 which is remote from the substrate 100. The developer discharge nozzle 11 stops scanning when reaching a scanning stop position P4 in the outer cup 5.

Thereafter the developer discharge nozzle 11 moves upward at the scanning stop position P4, thereafter moves to a position P5 over the other buffer pot 7, and moves downward into the buffer pot 7.

The substrate 100 is maintained in the state supplied with the developer for a constant time, thereby progressing the development. At this time, the motor 2 may rotate/drive the substrate holding part 1, for rotating the substrate 100. Thereafter the de-ionized water discharge nozzle 19 supplies de-ionized water onto the substrate 100, which in turn is rotated at a high speed for draining the developer off, and then dried for completing the development.

Figure 7A:
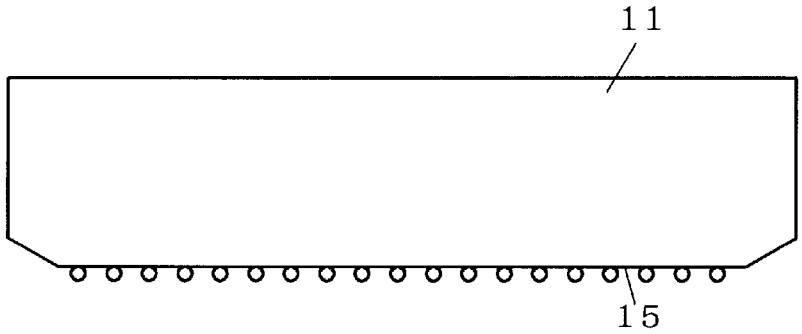
FIGS. 7(*a*) and 7(*b*) are front elevational views showing a state of discharging the developer from the developer discharge nozzle.
Figure 7B:
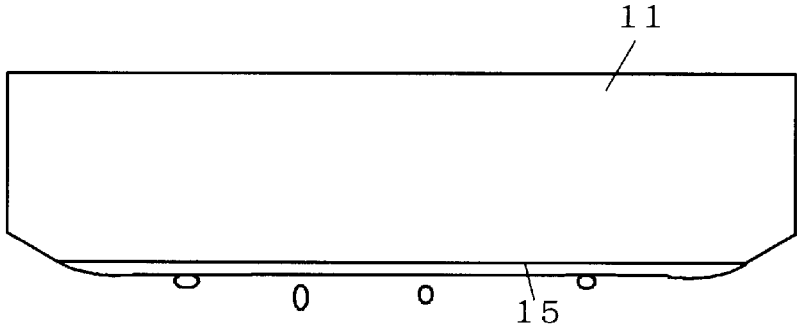

FIGS. 7A and 7B are front elevational views showing a state of discharging the developer from the developer discharge nozzle 11. Immediately after the discharge, the developer exudes from the slit discharge port 15 in the form of drops, as shown in FIG. 7A. After a lapse of a constant time from the discharge, the drops of the developer are connected with each other to form a strip (curtain) along the slit discharge port 15, as shown in FIG. 7B.

The aforementioned scanning start position P1 is so set that the scanning rate reaches a prescribed level before the developer discharge nozzle 11 starting the scanning reaches an edge of the substrate 100 and a sufficient time is ensured for forming a strip of the developer on the slit discharge port 15 as shown in FIG. 7B. For example, the scanning start position P1 is separated from the edge of the substrate 100 by about 10 to 100 mm opposite to the scanning direction A. According to this embodiment, the scanning start position P1 is separated by 50 mm from the edge of the substrate 100.

On the other hand, the discharge start position P2 is so set as to ensure a sufficient time for discharging the developer in the form of a strip before the developer discharge nozzle 11 reaches the edge of the substrate 100, in response to the scanning rate of the developer discharge nozzle 11 and the flow rate of the discharged developer.

When the scanning rate is increased, the developer discharge nozzle 11 reaches the edge of the substrate 100 from the scanning start position P1 in a shorter time, and hence the discharge start position P2 is approached to the scanning start position P1. For example, the developer discharge nozzle 11 starts discharging the developer after a lapse of 0.3 sec. from the start of scanning when the scanning rate is 100 mm/sec. When the scanning rate is 30 mm/sec., on the other hand, the developer discharge nozzle 11 starts discharging the developer after a lapse of 1.3 sec. from the starting of scanning.

When the flow rate of the discharged developer is large, the developer is discharged in the form of a strip in a short time, and hence the discharge start position P2 is approached to the edge of the substrate 100. For example, the developer discharge nozzle 11 starts discharging the developer in 0.1 to 1.0 sec. (e.g., 0.2 sec.) before reaching the edge of the substrate 100 when the flow rate of the discharged developer is 1.5 L/min. and the scanning rate is 70 mm/sec.

In order to reduce wasteful consumption of the developer, the discharge start position P2 is preferably positioned from the edge of the substrate 100 in a range so that the discharging developer is in the form of a strip before the developer discharge nozzle 11 reaches the edge of the substrate 100.

Figure 8:
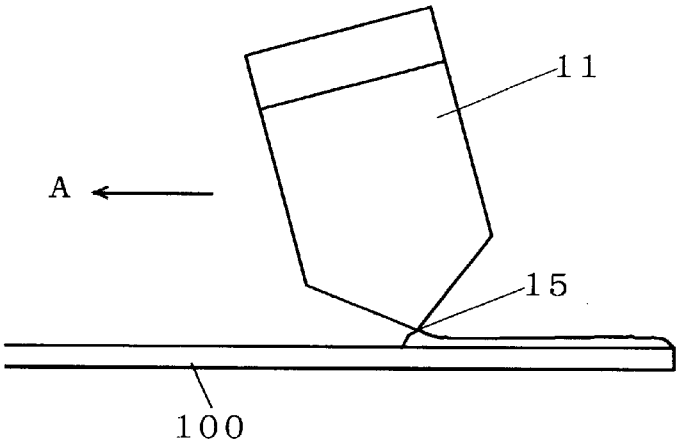
FIG. 8 is a side elevational view showing the developer discharge nozzle scanning a substrate.

FIG. 8 is a side elevational view showing the developer discharge nozzle 11 scanning the substrate 100. The direction for discharging the developer is inclined from the vertical downward direction opposite to the scanning direction A as hereinabove described, thereby suppressing the flow of the developer in the scanning direction A on the surface of the substrate 100 and inducing an opposite flow of the developer. Due to the suppression of flow of the developer in the scanning direction A, the developer is prevented from flowing in the scanning direction A beyond the developer discharge nozzle 11, and the homogeneity of the development is improved. Further due to the introduction of an opposite flow of the developer, small bubbles, called microbubbles, are prevented from being introduced on the surface of a photosensitive film on the substrate 100, and therefore defective development is suppressed.

In the developing apparatus according to this embodiment, the developer discharge nozzle 11 starts discharging the developer before reaching the stationary substrate 100, whereby the discharged developer is prevented from applying an impact onto the substrate 100. Thus, formation of bubbles in the developer is suppressed, and defective development is prevented.

Part of the developer around the slit discharge port 15, which comes into contact with the air during movement of the developer discharge nozzle 11, is discarded from the substrate 100, and the developer discharge nozzle 11 newly supplies the developer to the stationary substrate 100 when reaching the same. Thus, defective development by denatured part of the developer is prevented, and the surface of the photosensitive film provided on the substrate 100 is prevented from adhesion of particles formed by dried part of the developer.

The developer discharge nozzle 11 is linearly horizontally translated on the stationary substrate 100 while the slit discharge port 15 is adjacent to the upper surface of the substrate 100 so that the strip of the developer formed on the slit discharge port 15 is continuously in contact with the surface of the substrate 100. Thus, no impact is applied to the surface of the substrate 100 and the developer is homogeneously supplied to the overall surface thereof.

The developer discharge nozzle 11 continuously supplies the developer until passing over the substrate 100, thereby preventing the mounded developer from bad influence by an impact when stopping the discharge. Consequently, defective development is suppressed, and line width homogeneity of the developed photosensitive film pattern is improved.

The developer discharge nozzle 11 stops discharging the developer after passing over the substrate 100, thereby preventing the photosensitive film provided on the substrate 100 from application of an impact by droppage of the developer after stopping the discharge. Thus, defective development and deterioration of the line width homogeneity of the photosensitive film pattern are prevented.

The direction for discharging the developer is inclined oppositely to the scanning direction A from a vertical downward direction, thereby suppressing flowing of the developer in the scanning direction A on the surface of the substrate 100 while inducing opposite flowing of the developer. Thus, homogeneity of the development is improved, and defective development is prevented.

Second Embodiment

A developing apparatus according to a second embodiment of the present invention is now described. The structure of the developing apparatus according to the second embodiment is similar to that of the first embodiment, and hence redundant description is omitted.

Figure 9:
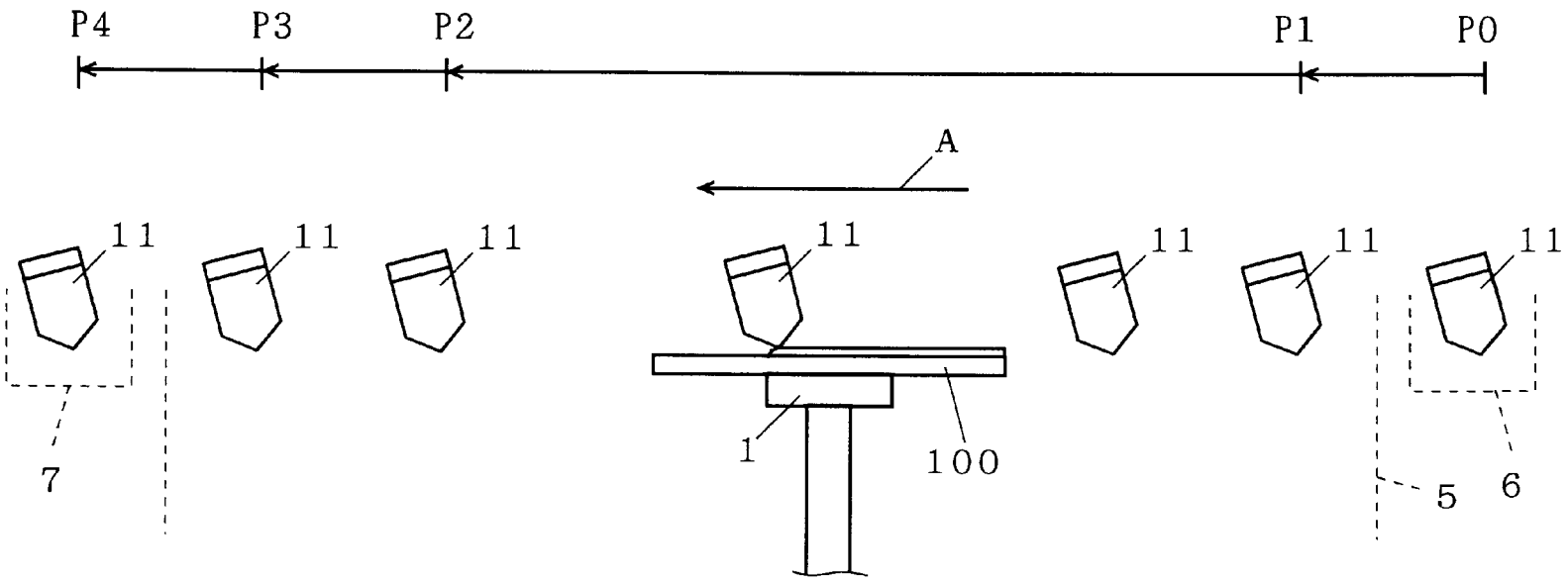
FIG. 9 is adapted to illustrate an exemplary operation of a developing apparatus according to a second embodiment of the present invention.

The developing apparatus according to the second embodiment is different from that of the first embodiment in an operation of a developer discharge nozzle 11. FIG. 9 is adapted to illustrate an exemplary operation of the developing apparatus according to the second embodiment. In development, a substrate holding part 1 holds a substrate 100 in a stationary state.

In a standby time, the developer discharge nozzle 11 stands by at a position P0 in a buffer pot 6. In the development, on the other hand, the developer discharge nozzle 11 moves upward, thereafter moves in a scanning direction A, and moves downward at a scanning start position P1 in an outer cup 5.

Thereafter the developer discharge nozzle 11 starts discharging a developer at a prescribed flow rate before or simultaneously with starting scanning at a scanning start position P1. According to this embodiment, the flow rate of the developer is set at 1.5 L/min.

After or simultaneously with starting discharging the developer, the developer discharge nozzle 11 starts scanning from the scanning start position P1 at a prescribed scanning rate. According to this embodiment, the scanning rate is set at 10 to 500 mm/sec.

The developer discharge nozzle 11 linearly moves on the substrate 100 from the scanning start position P1 in the scanning direction A while discharging the developer. Thus, the developer is continuously supplied to the overall surface of the substrate 100. The supplied developer is kept on the substrate 100 by its surface tension.

After passing over the substrate 100, the developer discharge nozzle 11 stops discharging the developer at a discharge stop position P2 separated from the substrate 100. The developer discharge nozzle 11 stops scanning when reaching a scanning stop position P3 in the outer cup 5.

Thereafter the developer discharge nozzle 11 moves upward at the scanning stop position P3, moves to a position P4 of another buffer pot 7, and moves downward into the buffer pot 7.

The substrate 100 is maintained in the state supplied with the developer for a constant time, thereby progressing the development. At this time, a motor 2 may rotate/drive the substrate holding part 1, for rotating the substrate 100. Thereafter a de-ionized water discharge nozzle 19 supplies de-ionized water onto the substrate 100, which in turn is rotated at a high speed for draining the developer off, and then dried for completing the development.

The aforementioned scanning start position P1 is so set that the scanning rate reaches a prescribed level before the developer discharge nozzle 11 starting the scanning reaches an edge of the substrate 100 and a sufficient time is ensured for forming a strip of the developer on a slit discharge port 15, as shown in FIG. 7B.

In particular, the developer discharge nozzle 11 starts discharging the developer at the scanning start position P1 before or simultaneously with starting scanning, thereby ensuring a sufficient time for forming a strip of the developer on the slit discharge port 15 before the developer discharge nozzle 11 reaches an edge of the substrate 100. Therefore, the scanning start position P1 can be approached to the edge of the substrate 100. According to this embodiment, the scanning start position P1 is separated by 10 to 100 mm from the edge of the substrate 100 oppositely to the scanning direction A.

At the scanning start position P1, the developer discharge nozzle 11 starts discharging the developer at a point of time capable of ensuring a time for discharging the developer in the form of a strip before reaching the edge of the substrate 100 in response to the scanning rate of the developer discharge nozzle 11 and the flow rate of the discharged developer.

When the scanning rate is increased, for example, the developer discharge nozzle 11 reaches the edge of the substrate 100 from the scanning start position P1 in a shorter time, and hence the discharge start timing is set in advance of the scanning start timing.

When the flow rate of the discharged developer is large, the developer is discharged in the form of a strip in a short time, and hence the discharge start timing can be approached to the scanning start timing.

In order to reduce wasteful consumption of the developer, the discharge start timing for the developer is preferably approached to the scanning start timing of the developer discharge nozzle 11 in the range capable of discharging the developer in the form of a strip before the developer discharge nozzle 11 reaches the edge of the substrate 100.

The direction for discharging the developer is inclined oppositely to the scanning direction A from a vertical downward direction similarly to the first embodiment, thereby suppressing flowing of the developer in the scanning direction A on the surface of the substrate 100 while inducing opposite flowing of the developer. Due to the suppression of flowing of the developer in the scanning direction A, the developer is prevented from flowing toward the scanning direction A beyond the developer discharge nozzle 11, and homogeneity of the development is improved. Due to the induction of opposite flowing of the developer, further, the surface of a photosensitive film provided on the substrate 100 is prevented from adhesion of small bubbles, called microbubbles, in the developer, and defective development is suppressed.

In the developing apparatus according to the second embodiment, the developer discharge nozzle 11 starts discharging the developer at the scanning start position P1, thereby preventing the substrate 100 from an impact by the discharged developer. Thus, formation of bubbles in the developer is suppressed, and defective development is prevented.

Part of the developer around the slit discharge port 15, which comes into contact with the air at the scanning start position P1 of the developer discharge nozzle 11, is discarded from the substrate 100, and the developer discharge nozzle 11 newly supplies the developer to the stationary substrate 100 when reaching the same. Thus, defective development by denatured part of the developer is prevented, and the surface of the photosensitive film provided on the substrate 100 is prevented from adhesion of particles formed by dried part of the developer.

The developer discharge nozzle 11 starts discharging the developer at the scanning start position P1, thereby ensuring a sufficient time for forming a strip of the developer discharged from the slit discharge port 15 after starting discharging the developer and before reaching the substrate 100. Thus, the scanning start position P1 of the developer discharge nozzle 11 can be approached to the edge of the substrate 100.

Further, the developer discharge nozzle 11 is linearly horizontally translated on the stationary substrate 100 while approaching the slit discharge port 15 to the upper surface of the substrate 100 so that the strip of the developer formed on the slit discharge port 15 is continuously in contact with the surface of the substrate 100. Thus, no impact is applied to the surface of the substrate 100 and the developer is homogeneously supplied to the overall surface of the substrate 100.

The developer discharge nozzle 11 continuously supplies the developer until passing over the substrate 100, thereby preventing the mounded developer from bad influence by an impact when stopping the discharge. Consequently, defective development is suppressed, and line width homogeneity of the developed photosensitive film pattern is improved.

The developer discharge nozzle 11 stops discharging the developer after passing over the substrate 100, thereby preventing the photosensitive film provided on the substrate 100 from application of an impact by droppage of the developer after stopping the discharge. Thus, defective development and deterioration of the line width homogeneity of the photosensitive film pattern are prevented.

The direction for discharging the developer is inclined oppositely to the scanning direction A, thereby suppressing flowing of the developer in the scanning direction A on the surface of the substrate 100 while inducing opposite flowing of the developer. Thus, homogeneity of the development is improved, and defective development is prevented.

While the developer discharge nozzle 11 stops discharging the developer at a position between the edge of the substrate 100 and the scanning stop position P3 after passing over the substrate 100 in the second embodiment, the developer discharge nozzle 11 may alternatively stop discharging the developer at the scanning stop position P3.

A developing apparatus according to a variation of the present invention is now described.

Figure 10:
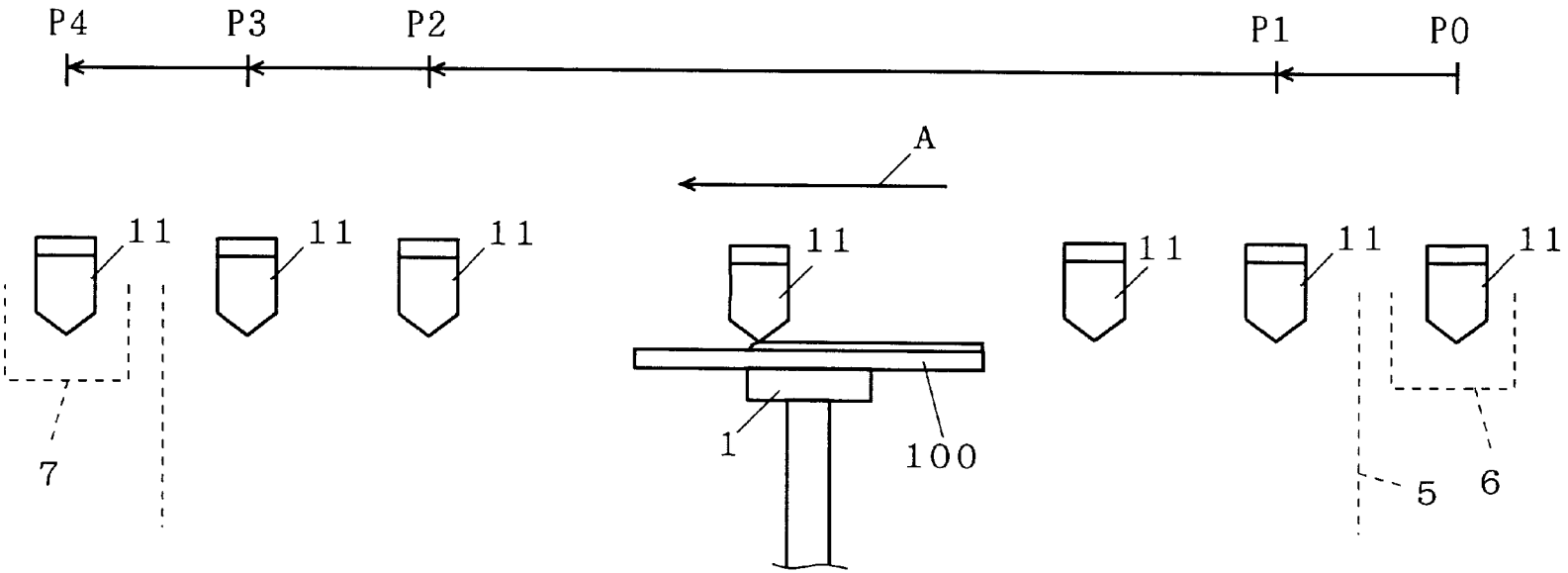
FIG. 10 is adapted to illustrate another exemplary operation of the developing apparatus shown in FIG. 1.

The developing apparatus according to this variation is different from those of the first and the second embodiments in that a developer discharge nozzle 11 is not rotatable along arrow Q as shown in FIG. 3. FIG. 10 shows a case where an inclination angle $\alpha$ of the developer discharge nozzle 11 is 0°. The structure except the above and the operation of the developing apparatus according to this variation are similar to those of the first and the second embodiments, and hence redundant description is omitted.

The above-described structure achieves similar effect as in the first and the second embodiments except the effect achieved by inclining the developing discharge nozzle 11.

While the invention has been shown and described in detail, the foregoing description is in all aspects illustrative and not restrictive. It is therefore understood that numerous modifications and variations can be devised without departing from the scope of the invention.

We claim:

1. An apparatus for developing a substrate by discharging a developer on said substrate, said apparatus comprising:

a) holding means for holding a substrate in a stationary, horizontal state;

b) a developer discharge nozzle discharging a developer onto said substrate;

c) moving means for moving said developer discharge nozzle alone a prescribed scanning path while said substrate is in said stationary, horizontal state; said prescribed path extending from a scanning start position located on a first side of said substrate, extending over a first edge of said substrate, continuing across the top of said substrate, leaving said substrate at a second edge of said substrate and then continuing to a scanning stop position located on a second side of said substrate;

d) discharge control means for controlling said developer discharge nozzle to start discharging said developer before reaching said first edge of said substrate.

2. The apparatus in accordance with claim 1, wherein said discharge control means controls said developer discharge nozzle to start discharging said developer at a position between said scanning start position and said first edge.

3. The apparatus in accordance with claim 2, wherein said discharge control means controls said developer discharge nozzle to stop discharging said developer after passing over said second edge of said substrate and before reaching said scanning stop position.

4. The apparatus in accordance with claim 3, wherein said prescribed scanning path is a substantially straight path and wherein said developer discharge nozzle has a discharge slit extending along a horizontal direction that is perpendicular to said scanning path and having a length that is larger than the maximum size of said substrate as measured along said horizontal direction.

5. The apparatus in accordance with claim 4, wherein said moving means moves said developer discharge nozzle to keep a constant distance between a major surface of said substrate and said slit discharge port.

6. The apparatus in accordance with claim 5, wherein said discharge control means controls said developer discharge nozzle to downwardly discharge said developer in the form of a curtain from said discharge slit before reaching said first edge.

7. The apparatus in accordance with claim 6, wherein said developer discharge nozzle discharges said developer in a direction inclined oppositely to said scanning path of said developer discharge nozzle in a vertical downward direction.

8. The apparatus in accordance with claim 1, wherein said discharge control means controls said developer discharge nozzle to start discharging said developer at said scanning start position.

9. The apparatus in accordance with claim 8, wherein said discharge control means controls said developer discharge nozzle to start supplying said developer before or simultaneously with the start of scanning.

10. The apparatus in accordance with claim 9, wherein said discharge control means controls said developer discharge nozzle to stop discharging said developer after passing over said second edge of said substrate and before reaching said scanning stop position.

11. The apparatus in accordance with claim 10, wherein said prescribed scanning path is a substantially straight path and wherein said developer discharge nozzle has a discharge slit extending along a horizontal direction that is perpendicular to said scanning path and having a length that is larger than the maximum size of said substrate as measured along said horizontal direction.

12. The apparatus in accordance with claim 11, wherein said moving means moves said developer discharge nozzle to keep a constant distance between a major surface of said substrate and said discharge slit.

13. The apparatus in accordance with claim 12, wherein said discharge control means controls said developer discharge nozzle to downwardly discharge said developer in the form of a curtain from said discharge slit before reaching said first edge.

14. The apparatus in accordance with claim 13, wherein said developer discharge nozzle discharges said developer in a direction that is inclined from a normal direction and opposite to said scanning direction of said developer discharge nozzle.

15. An apparatus for developing a substrate by discharging a developer onto said substrate, said apparatus comprising:

a) a substrate holder holding a substrate in a stationary, horizontal state;

b) a developer discharge nozzle discharging a developer onto said substrate;

c) a displacement device moving said developer discharge nozzle along a prescribed scanning path while said substrate is in said stationary, horizontal state; said prescribed path extending from a scanning start position located on a first side of said substrate, extending over a first edge of said substrate, continuing across the top of said substrate, leaving said substrate at a second edge of said substrate and than continuing to a scanning stop position located on a second side of said substrate;

d) a discharge control device controlling said developer discharge nozzle to start discharging said developer before reaching said first edge of said substrate.

16. The apparatus in accordance with claim 15, wherein said discharge control device controls said developer discharge nozzle to start discharging said developer at a position between said scanning start position and said first edge.

17. The apparatus in accordance with claim 16, wherein said discharge control device controls said developer discharge nozzle to stop discharging said developer after passing over said second edge of said substrate and before reaching said scanning stop position.

18. The apparatus in accordance with claim 17, wherein said prescribed scanning path is a substantially straight path and wherein said developer discharge nozzle has a discharge slit extending along a horizontal direction that is perpendicular to said scanning path and having a length that is larger than the maximum size of said substrate as measured along said horizontal direction.

19. The apparatus in accordance with claim 18, wherein said displacement device moves said developer discharge nozzle to keep a constant distance between a major surface of said substrate and said slit discharge port.

20. The apparatus in accordance with claim 19, wherein said discharge control device controls said developer discharge nozzle to downwardly discharge said developer in the form of a curtain from said discharge slit before reaching said first end.

21. The apparatus in accordance with claim 20, wherein said developer discharge nozzle discharges said developer in a path inclined oppositely to said scanning direction of said developer discharge nozzle in a vertical downward direction.

22. The apparatus in accordance with claim 15, wherein said discharge control device controls said developer discharge nozzle to start discharging said developer at said scanning start position.

23. The apparatus in accordance with claim 22, wherein said discharge control device controls said developer discharge nozzle to start supplying said developer before or simultaneously with the start of scanning.

24. The apparatus in accordance with claim 23, wherein said discharge control device controls said developer discharge nozzle to stop discharging said developer after passing over said second edge of said substrate and before reaching said scanning stop position.

25. The apparatus in accordance with claim 24, wherein said prescribed scanning path is a substantially straight path and wherein said developer discharge nozzle has a discharge slit extending along a horizontal direction that is perpendicular to said scanning path and having a length that is larger than the maximum size of said substrate as measured along said horizontal direction.

26. The apparatus in accordance with claim 25, wherein said displacement device moves said developer discharge nozzle to keep a constant distance between a major surface of said substrate and said discharge slit.

27. The apparatus in accordance with claim 26, wherein said discharge control device controls said developer discharge nozzle to downwardly discharge said developer in the form of a curtain from said discharge slit before reaching said first end.

28. The apparatus in accordance with claim 27, wherein said developer discharge nozzle discharges said developer in a direction that is inclined from a normal direction and opposite to said scanning path of said developer discharge nozzle.

* * * * *